US008544709B2

(12) United States Patent
Paik

(10) Patent No.: US 8,544,709 B2
(45) Date of Patent: Oct. 1, 2013

(54) BACKPACK WITH SHOULDER STRAP HEIGHT ADJUSTMENT UNIT

(76) Inventor: Ji Sook Paik, Seoul (KR)

( * ) Notice: Subject to any disclaimer, the term of this patent is extended or adjusted under 35 U.S.C. 154(b) by 379 days.

(21) Appl. No.: 12/950,574

(22) Filed: Nov. 19, 2010

(65) Prior Publication Data

US 2012/0085803 A1 Apr. 12, 2012

(30) Foreign Application Priority Data

Oct. 12, 2010 (KR) ..... 10-2010-0099193

(51) Int. Cl.
*A45F 3/04* (2006.01)

(52) U.S. Cl.
USPC ..... 224/632; 224/633; 224/634; 24/579.11

(58) Field of Classification Search
USPC ..... 224/627, 628, 631, 632, 634; 24/194, 24/579.09, 615, 579.11
See application file for complete search history.

(56) References Cited

U.S. PATENT DOCUMENTS

| | | | | |
|---|---|---|---|---|
| 4,013,201 | A * | 3/1977 | Potter | 224/262 |
| 4,860,936 | A * | 8/1989 | Lowe | 224/632 |
| 4,894,890 | A * | 1/1990 | Kasai | 24/579.09 |
| 4,945,614 | A * | 8/1990 | Kasai | 24/579.09 |
| 5,004,135 | A * | 4/1991 | Dufournet et al. | 224/632 |
| 5,284,279 | A * | 2/1994 | Sason et al. | 224/632 |
| 5,361,955 | A * | 11/1994 | Gregory | 224/630 |
| 5,449,102 | A * | 9/1995 | Sason | 224/632 |
| 5,730,347 | A * | 3/1998 | Finot | 224/631 |
| 5,971,244 | A * | 10/1999 | Jaeger | 224/632 |
| 6,626,342 | B1 * | 9/2003 | Gleason | 224/633 |
| 7,152,771 | B2 * | 12/2006 | Le Gal et al. | 224/631 |
| 7,232,048 | B2 * | 6/2007 | Le Gal et al. | 224/201 |
| 7,287,677 | B2 * | 10/2007 | Reid | 224/637 |
| 7,770,769 | B2 * | 8/2010 | Hurn | 224/631 |
| 2004/0178245 | A1 * | 9/2004 | Le Gal et al. | 224/631 |
| 2011/0198377 | A1 * | 8/2011 | Froidevaux et al. | 224/633 |

FOREIGN PATENT DOCUMENTS

| | | | |
|---|---|---|---|
| CH | 667195 | A5 * | 9/1988 |
| DE | 202008017464 | U1 * | 12/2009 |
| FR | 2507877 | A1 * | 12/1982 |
| FR | 2677235 | A1 * | 12/1992 |
| FR | 2733129 | A1 * | 10/1996 |
| WO | WO 9604818 | A1 * | 2/1996 |

* cited by examiner

*Primary Examiner* — Nathan J Newhouse
*Assistant Examiner* — Todd Anderson
(74) *Attorney, Agent, or Firm* — Kile Park Reed & Houtteman PLLC

(57) ABSTRACT

Disclosed is a backpack with a shoulder strap height adjustment unit, in which a rail frame is installed on a back surface of the backpack and shoulder straps are vertically guided by the rail frame, thereby allowing the height of the shoulder straps to be adjusted according to the physical characteristics of a user.

9 Claims, 12 Drawing Sheets

(a) (b)

BACKPACK WITH SHOULDER STRAP HEIGHT ADJUSTMENT UNIT

BACKGROUND OF THE INVENTION

1. Field of the Invention

The present invention relates to a backpack, and more particularly to a backpack with a shoulder strap height adjustment unit which is guided by a rail frame installed on a back surface of the backpack to adjust the height of shoulder straps with respect to the back surface of the backpack so as to allow a user to wear the backpack while adjusting the height of the shoulder straps according to the physical characteristics of the user.

2. Description of the Related Art

In general, a backpack is provided with various types of straps used when a user wears the backpack. That is, as shown in FIG. 1, a conventional backpack 1 includes shoulder straps 2 worn over the shoulders of the user, waist straps 3 fastened across the waist of the user, and chest straps 4 fastened across the chest of the user.

The shoulder straps 2 serve to support the backpack 1, and the waist straps 3 and the chest straps 4 serve to prevent the backpack 1 from tilting backwards and to more stably adhere the backpack 1 to the body of the user so as to prevent the backpack 1 from swinging while keeping a state in which the user stably wears the backpack 1.

The shoulder straps 2, which are the principle components in supporting the backpack 1, do not have a length adjustment function and are fixed to the same position of the back surface of any backpack, thus being worn by users in the same shape regardless of physical characteristics of the users.

That is, the upper ends of the shoulder straps 2 are sewn to the upper end of the back surface of the backpack 1, and the lower ends of the shoulder straps 2 are connected to straps 8 sewn to the lower end of the back surface of the backpack 1 such that the length of the shoulder straps 2 is adjustable. Therefore, a user has no option but to use the backpack 1 in a state in which the upper ends of the shoulder straps 2 are fixed to the upper end of the backpack 1 regardless of amounts or sizes of articles received in the backpack 1 or a size of the backpack 1.

If the user wears the backpack 1 in which the upper ends of the shoulder straps 2 are simply fixed in such a manner, the lower end of the backpack 1 may ride excessively low or high according to the body size of the user and thus the user cannot stably wear the backpack 1. Therefore, when the backpack 1 is worn for a long period of time or when mountain claiming, such an unstable worn state of the backpack 1 provides considerable fatigue and inconvenience to the user.

For example, if a short user wears the backpack 1, the backpack 1 is located at a position below the waist of the user, and thus the backpack 1 may cause unpleasant contact with the body of the user and provide inconvenience to the user due to swinging of the lower end of the backpack 1 during walking and the user may easily feel tired. On the other hand, if a tall user wears the backpack 1, the backpack 1 is located at a position above the waist of the user, and thus the backpack 1 may be out of balance due to upward movement of the center of gravity and the user may easily feel tired or stable walking of the user may be difficult.

Although the waist straps 3 and the chest straps 4 assist the backpack 1 to be in close contact with the body of the user, the waist straps 3 and the chest straps 4 cannot adjust the center of gravity, thus being incapable of solving the unbalanced state of the backpack 1.

Accordingly, proper adjustment of a position of the shoulder straps 2 of the backpack 1 during contact between the backpack 1 and the body of the user is required.

SUMMARY OF THE INVENTION

Therefore, the present invention has been made in view of the above problems, and it is an object of the present invention to provide a backpack with a shoulder strap height adjustment unit, which adjusts the height of a position of shoulder straps with respect to a back surface of the backpack, thereby allowing a user to randomly adjust the height of the shoulder straps.

It is another object of the present invention to provide a backpack with a shoulder strap height adjustment unit, which provides improved stiffness to the backpack while maintaining a balanced structure of the backpack through a rail frame installed on a back surface of the backpack to adjust the height of shoulder straps.

In accordance with an aspect of the present invention, the above and other objects can be accomplished by the provision of a backpack with a shoulder strap height adjustment unit including a back surface, a rail frame vertically extended at the center of the back surface, shoulder straps including left and right shoulder straps, the upper ends of which are connected integrally to form an elevation part, an elevation loop being formed at one surface of the elevation part opposite the other surface, on which the left and right shoulder straps are formed, and inserted into the rail frame such that the height of the left and right shoulder straps is adjustable along the rail frame, and a strap adjustment unit to adjust the height of the shoulder straps. The strap adjustment unit may include a strap connector, a first strap to connect one end of the elevation part of the shoulder straps and the strap connector, a second strap provided with one end connected and fixed to the strap connector and the other end serving as a free end and protruded to the upper portion of the backpack, and a third strap provided with one end fixed to one end of the lower portion of the back surface and the other end serving as a free end and protruded to the lower portion of the backpack via the strap connector.

Thereby, the upper ends of the shoulder straps may be vertically guided by the rail frame such that the shoulder straps may be moved upwards and downwards, and the shoulder straps may be simply moved upwards and downwards by pulling the second strap and the third strap upwards and downwards.

The rail frame may be made of metal, and an elevation loop may be formed at the middle portion of the inner surface of the elevation part such that the rail frame passes through the elevation loop.

The strap connector may include a first connector formed in a U-shape having an entrance at the upper portion thereof, and provided with guide grooves formed along both inner side surfaces of the first connector from the upper surface of the first connector, a slot connected with the guide grooves and formed at the lower portion of the first connector by slot frames facing each other, and a first strap bar traversing the first connector and formed at the upper end of the first connector within a range not obstructing entrances of the guide grooves such that the first strap is connected to the first strap bar, and a second connector provided with a second strap bar formed at the upper portion thereof such that the second strap is connected to the second strap bar, a third strap bar traversing the second connector and formed at the middle portion thereof such that the third strap is connected to the third strap bar, and a guide plate extended downwards from both side surfaces of the second connector so as to be inserted into the guide grooves of the first connector from above.

Stoppers may be provided at the lower end of the body of the second connector by forming stepped portions at the middle portion of the guide plate and be caught by the upper end of one slot frame of the slot frames to form the slot.

Further, the stoppers may be provided at the lower end of the body of the second connector by forming stepped portions at the middle portion of the guide plate and be caught by the upper end of one slot frame of the slot frames to form the slot, and the upper end of the other slot frame may contact the lower end of the third strap bar.

Thereby, when the first connector and second connector are in a free state under the straps are connected to the first connector and the second connector, one end of the second connector may be inserted downwardly to the inside of the first connector. In this state, the third strap may be inserted into a gap between the first connector and the second connector so as to prevent upward movement of the strap connector. Then, when the second strap is pulled upwards in order to move the shoulder straps upwards, or when the third strap is pulled downwards in order to move the shoulder straps downwards, the second connector may be lifted up and the end of the third strap inserted into the gap between the first connector and the second connector becomes free end and thus the strap connector may be moved. In the moved state of the strap connector, when the force applied to the second strap or the third strap is released, the second connector may fall free end and be connected to the first connector in the same manner as the original state, and thus the third strap is fixed again, thereby fixing the upper limit of the shoulder straps.

In accordance with another aspect of the present invention, there is provided a backpack, in which shoulder straps are installed on a back surface of the backpack such that a user may carry the backpack on his/her back, including a rail frame vertically extended at the center of the back surface, shoulder straps including left and right shoulder straps, the upper ends of which are connected integrally to form an elevation part connected to the rail frame such that the elevation part may be moved upwards and downwards along the rail frame, a first connector formed in a U-shape having an entrance at the upper portion thereof, and provided with guide grooves formed along both inner side surfaces of the first connector from the upper surface of the first connector, a slot connected with the guide grooves and formed at the lower portion of the first connector by slot frames facing each other, and a first strap bar traversing the first connector and formed at the upper end of the first connector within a range not obstructing entrances of the guide grooves such that the first strap is connected to the first strap bar, a second connector provided with a second strap bar formed at the upper portion thereof such that the second strap is connected to the second strap bar, a third strap bar traversing the second connector and formed at the middle portion thereof such that the third strap is connected to the third strap bar, and a guide plate extended downwards from both side surfaces of the second connector so as to be inserted into the guide grooves of the first connector from above, the first strap to connect one end of the elevation part and the strap connector, the second strap provided with one end connected and fixed to the strap connector and the other end serving as a free end and protruded to the upper portion of the backpack, and a third strap provided with one end fixed to one end of the lower portion of the back surface and the other end serving as a free end and protruded to the lower portion of the backpack via the third strap bar.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Now, a preferred embodiment of the present invention will be described in detail with reference to the annexed drawings.

Figure 1:
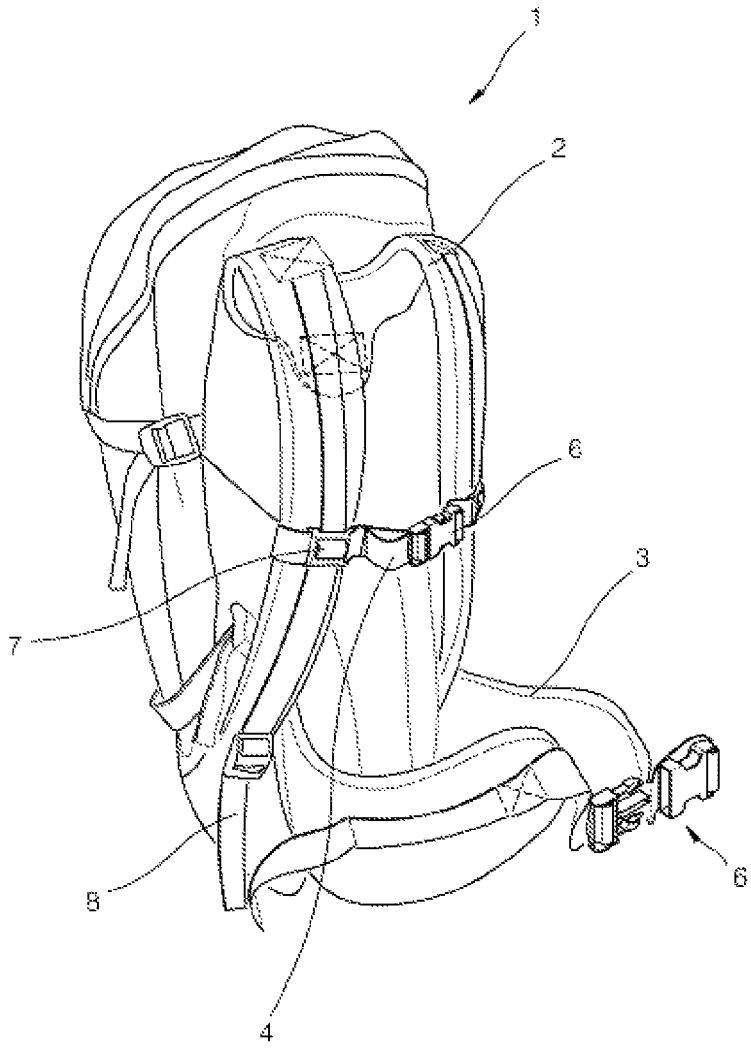
Fig. 1 (Prior Art)
FIG. 1 is a perspective view exemplarily illustrating a back surface of a conventional backpack.
Figure 2:
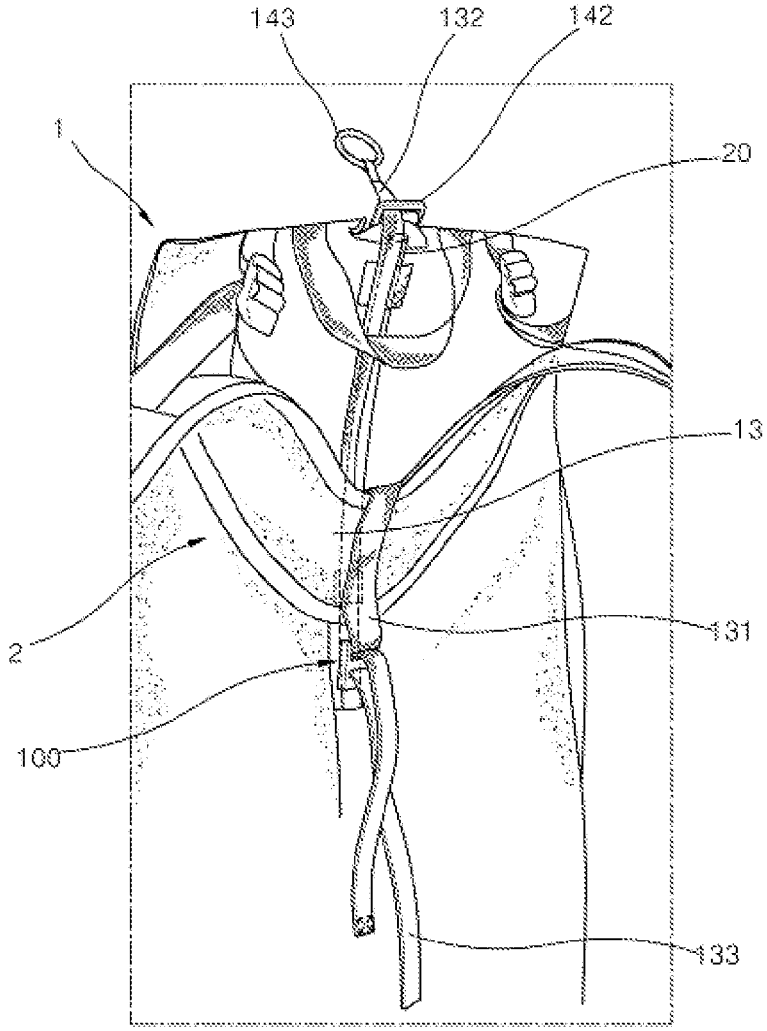
FIG. 2 is a partial perspective view illustrating a back surface of a backpack in accordance with the present invention.
Figure 3:
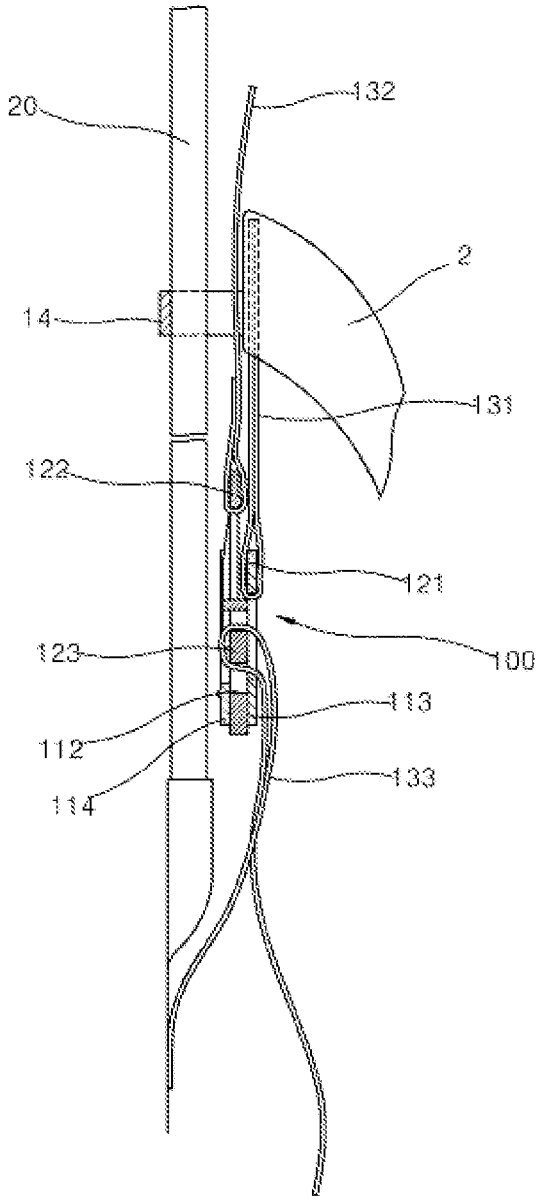
FIG. 3 is a partially enlarged longitudinal-sectional view illustrating an essential portion of the backpack in accordance with the present invention.
Figure 4:
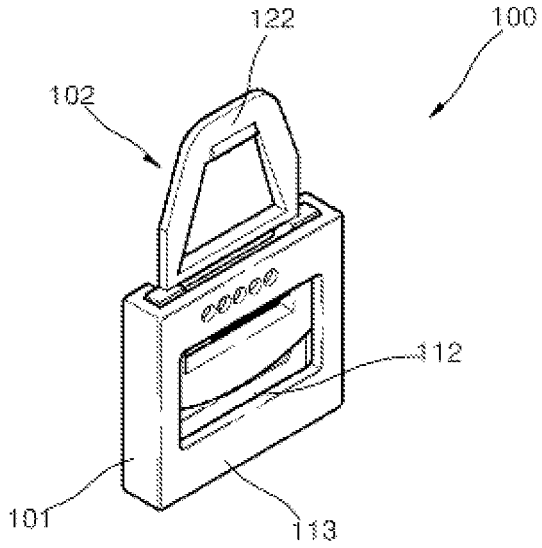
FIG. 4 is a perspective view exemplarily illustrating a strap connector in accordance with the present invention in an assembled state.
Figure 5:
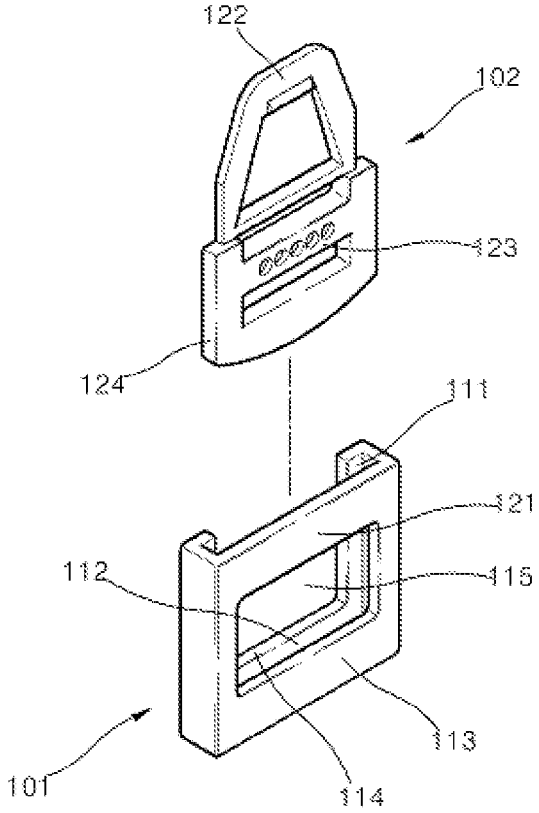
FIG. 5 is an exploded perspective view of FIG. 4.
Figure 6:
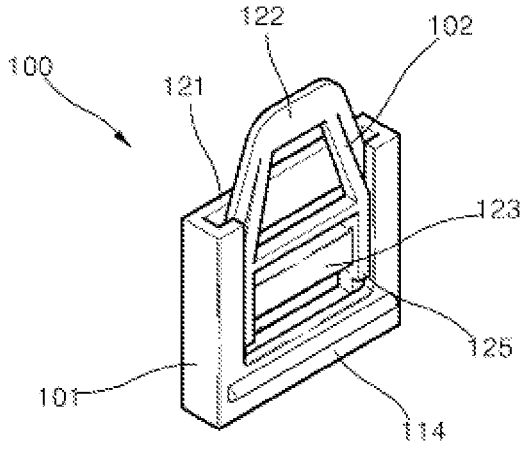
FIG. 6 is a perspective view illustrating a rear surface of the strap connector of FIG. 4.
Figure 7:
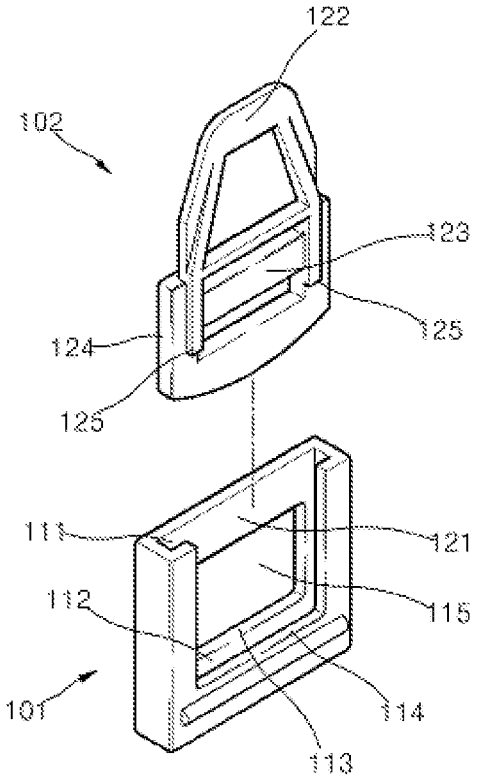
FIG. 7 is an exploded perspective view of FIG. 6.

FIG. 2 is a partial perspective view illustrating a back surface of a backpack in accordance with the present invention. FIG. 3 is a partially enlarged longitudinal-sectional view illustrating an essential portion of the backpack in accordance with the present invention.

As shown in FIGS. 2 and 3, a vertically extended rail frame 20 is installed at the center of a back surface of a backpack 1 in accordance with the present invention, and the respective upper ends of a left shoulder strap 11 and a right shoulder strap 12 are connected integrally to form an elevation part 13 at the connection portion therebetween. The elevation part 13 includes a front surface on which the left shoulder strap 11 and the right shoulder strap 12 are formed, and a rear surface opposite the front surface, and an elevation loop 14 is formed at the lower end of the rear surface of the elevation part 13. The elevation loop 14 is coupled with the rail frame 20 and vertically moves along the rail frame 20, thereby causing the height of the left shoulder strap 11 and the right shoulder strap 12 with respect to the back surface of the backpack 1 to be adjusted. The respective lower ends of the left shoulder strap 11 and the right shoulder strap 12 are fixed to the left and right sides of the lower portion of the back surface of the backpack 1.

A pocket provided with the opened upper portion is formed at the lower portion of the center of the back surface such that the lower end of the rail frame 20 is inserted into the pocket and the upper end of the rail frame 20 is inserted into a loop (shown at least in FIGS. 2 and 10) formed at the upper portion of the center of the back surface, and thus the upper and lower ends of the rail frame 20 are fixed to the back surface of the backpack 1. The rail frame 20 is preferably made of a synthetic resin or metal, and is formed in a gentle curve along the body line of a user to induce close adhesion with the body of the user during contacting the body of the user.

In order to adjust the height of the shoulder straps 2 in accordance with the present invention, a strap adjustment unit is required. The strap adjustment unit includes a plurality of straps and a strap connector 100 connecting the straps. FIGS. 4 to 9 illustrate the strap connector 100 connecting the straps and a connected state of the strap connector 100 with the straps.

With reference to FIGS. 4 to 9, the strap connector 100 in accordance with the present invention is formed by connecting a first connector 101 and a second connector 102. The first connector 101 is configured so as to receive the second connector 102, and the second connector 102 is configured so as to freely move in the first connector 101 without locking.

The first connector 101 is formed in a 凹 shape having an entrance at the upper portion thereof, guide grooves 111 are formed along both inner side surfaces of the first connector 101 from the upper surface of the first connector 101, and a slot 112 connected with the guide grooves 111 is formed at the lower portion of the first connector 101 by slot frames 113 and 114 facing each other.

The slot 112 is continuously connected with the guide grooves 111, and a height of the upper end of one slot frame (herein, the slot frame 113) of the slot frames 113 and 114 facing each other is greater than a height of the upper end of the other slot frame (herein, the slot frame 114) of the slot frames 113 and 114 facing each other.

A first strap bar 121 traversing the first connector 101 is formed at the upper end of the slot frame 113 of the first connector 101 so as not to obstruct the entrances of the guide grooves 111, and a first strap 131 is connected to the first strap bar 121 and is then fixed to the lower end of the elevation part 13 of the shoulder straps 2.

Therefore, the first connector 101 has a rectangular shape provided with a strap inlet 115 formed through one side surface of the first connector 101 by the first strap bar 121.

The second connector 102 is provided with a second strap bar 122 formed at the upper portion thereof such that a second strap 132 is connected to the second strap bar 122, and is provided with a third strap bar 123 traversing the second connector 102 and formed at the middle portion of the second connector 102 such that a third strap 133 is connected to the third strap bar 123. Further, a guide plate 124 is extended downwards from both sides of the second connector 102 and is inserted into the guide grooves 111 of the first connector 101 from above.

The guide plate 124 of the second connector 102 is configured such that it passes through the slot 112 and is protruded downwards from the slot 112 when the guide plate 124 of the second connector 102 is completely inserted into the first connector 101, and stoppers 125 are provided at the lower end of the body of the second connector 102 by forming stepped portion at the middle portion of the guide plate 124 such that the stoppers 125 are caught by the upper end of the slot frame 114 at one side of the first connector 101. Here, the stoppers 125 are located at both sides of the outer surface of the third strap bar 123.

Under a state in which the stoppers 125 contact the upper end of the slot frame 114 at one side of the first connector 101, the upper end of the slot frame 113 at the other side of the first connector 101 is located at a position contacting the lower end of the third strap bar 123. The slot frame 114 contacting the stopper 125 is low in height and the slot frame 113 contacting the third strap bar 123 is high in height, and thus when the second connector 102 is completely connected to the first connector 101, the upper end of the low slot frame 114 at the side where the stoppers 125 are located is separated from the lower end of the third strap bar 123 by a small interval and the upper end of the high slot frame 113 contacts the lower end of the third strap bar 123.

The second connector 102 is loosely connected to the inside of the first connector 101 such that the second connector 102 may freely move within the first connector 101. Consequently, under a state in which the strap connector 100 is installed on the backpack 1, the second connector 102 is connected to the inside of the first connector 101 from above at all times.

A connected state of the first strap 131, the second strap 132 and the third strap 133 to the strap connector 100 will be described now. The first strap 131 is connected to the first strap bar 121 of the first connector 101 and is then sewn to the lower end of the elevation part 13 of the shoulder straps 2, one end of the second strap 132 is connected and fixed to the second strap bar 122 located at the upper portion of the second connector 102 and the other end of the second strap 132 serving as a free end is protruded to the upper portion of the backpack 1, and the third strap 133 passes through the third strap bar 123 of the second connector 102 under the condition that one end of the third strap 133 is fixed to one end of the lower portion of the backpack 1, and the other end of the third strap 133 serving as a free end drops to the lower portion of the backpack 1.

The first strap 131 functions to connect the elevation part 13 of the shoulder straps 2 and the strap connector 100, and more specifically to hang the first connector 101 on the lower end of the elevation part 13 of the shoulder straps 2. That is, the first strap 131 hangs the first connector 101 receiving the second connector 102 on the lower end of the elevation part 13 of the shoulder straps 2, thereby allowing the strap connector 100 to move according to vertical movement of the elevation part 13 of the shoulder straps 2 while maintaining the designated interval.

The lower end of the second strap 132 is connected and fixed to the upper end of the second connector 102, i.e., the second strap bar 122, and the upper end of the second strap 132 serves as a free end and is protruded to the upper portion of the backpack 1. Thereby, the elevation part 13 of the shoulder straps 2 may be moved upwards by allowing a user to pull the free end of the second strap 132 upwards.

A loop 142 through which the second strap 132 passes is formed at the upper end of the center of the backpack 1, and a ring 143 is installed at the upper end of the second strap 132. The ring 143 has a greater diameter than the inner diameter of the loop 142, thereby maintaining a state in which the upper end of the second strap 132 is inserted into the loop 142. Therefore, the free end of the second strap 132 remains above the backpack 1.

One end of the third strap 133 is fixed to the lower portion of the back surface of the backpack 1 and thus forms a fixed end, and the other end of the third strap 133 passes through the strap connector 100 and then drops to the lower portion of the backpack 1 and thus forms a free end. In more detail, the third strap 133 extended from the fixed end enters the strap connector 100 through the strap inlet 115, is wound around the third strap bar 123 of the second connector 102 from above, is drawn out of the strap connector 100 through the strap inlet 115, and then drops to the lower portion of the back pack 1.

Therefore, as seen from the drawings, the third strap 133 is connected to the strap connector 100 such that the third strap 133 is wound around the strap connector 100 one time.

Figure 8:
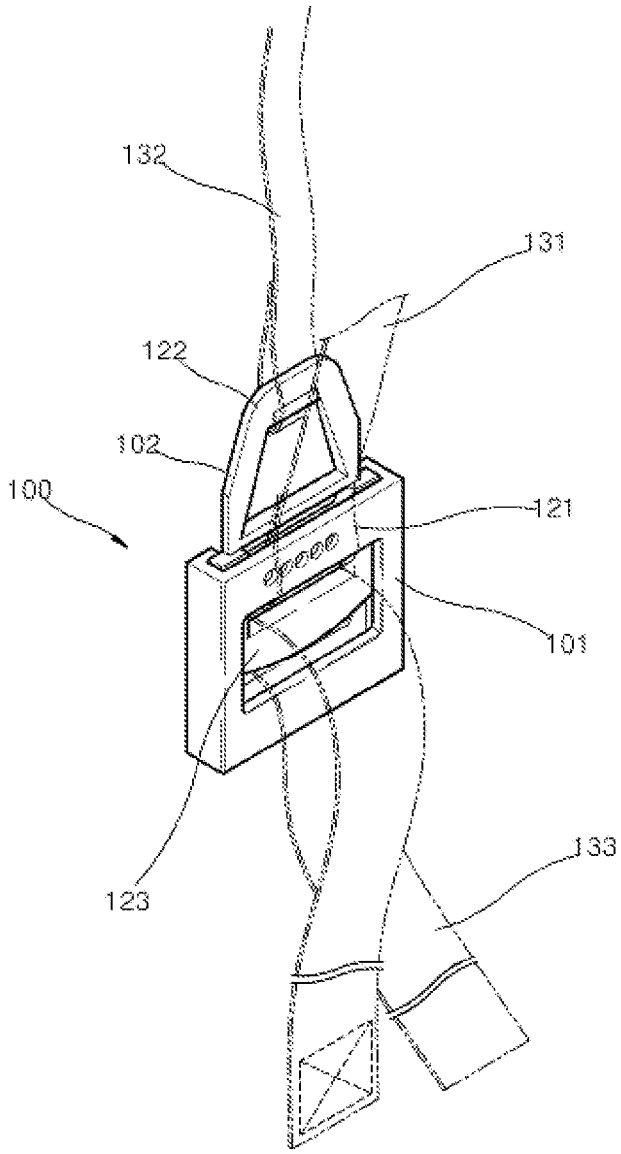
FIG. 8 is a perspective view illustrating a connected state of the strap connector in accordance with the present invention with straps.
Figure 9:
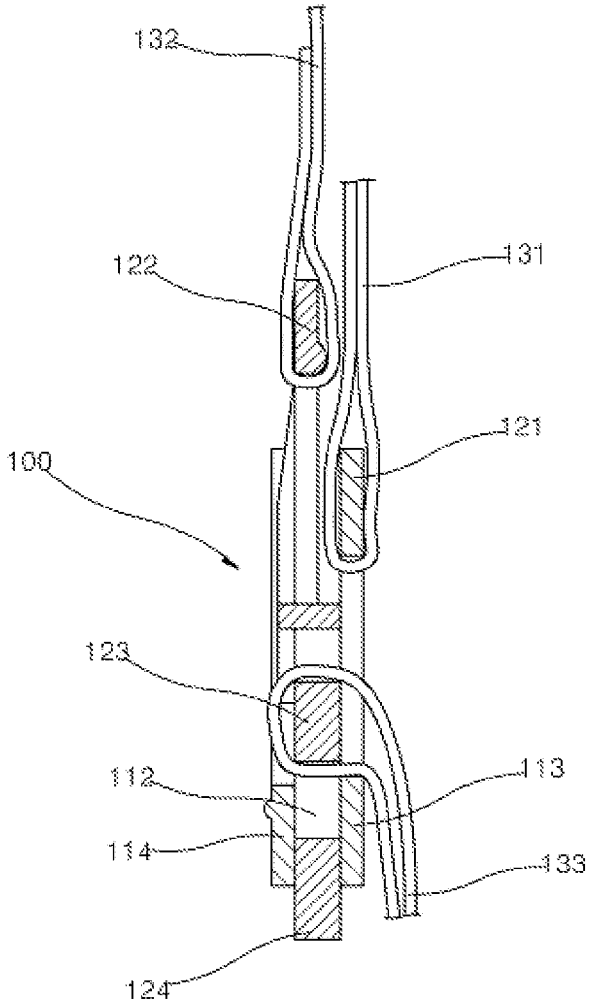
FIG. 9 is a longitudinal-sectional view of FIG. 8.

FIGS. 8 and 9 illustrate the connected state of the respective straps to the strap connector 100. In such a connected state, the first connector 101 is hung on the lower end of the elevation part 13 of the shoulder straps 2 by the first strap 131, and the state in which the second connector 102 is downwardly connected to the inside of the first connector 101 is maintained.

In such a state, the shoulder straps 2 are fixed without adjusting the height of the shoulder straps 2. That is, the connection portion of one end of the third strap 133 to the third strap bar 123 is inserted into a gap between the slot frames 113 and 114 and the third strap bar 124, formed by moving the second connector 102 downwards and thus controls movement of the strap connector 100, thereby allowing movement of the shoulder straps 2 to be stopped. Although the shoulder straps 2 and the strap connector 100 freely move downwardly due to the weight of the upper ends of the shoulder straps 2, a user naturally lifts the shoulder straps 2 upwards during using the backpack 1, and thus downward movement of the shoulder straps 2 is not important when the backpack 1 is not in use.

That is, since load is applied to the shoulder straps 2 when carrying the backpack 1, it is only necessary to prevent the elevation part 13 of the shoulder straps 2 from sliding upward, and upward sliding of the elevation part 13 of the shoulder straps 2 is prevented by the strap connector 100.

Hereinafter, a function of the present invention based on a fixed state in which the third strap 133 is inserted into the gap between the first connector 101 and the second connector 102 will be described in detail.

Figure 10:
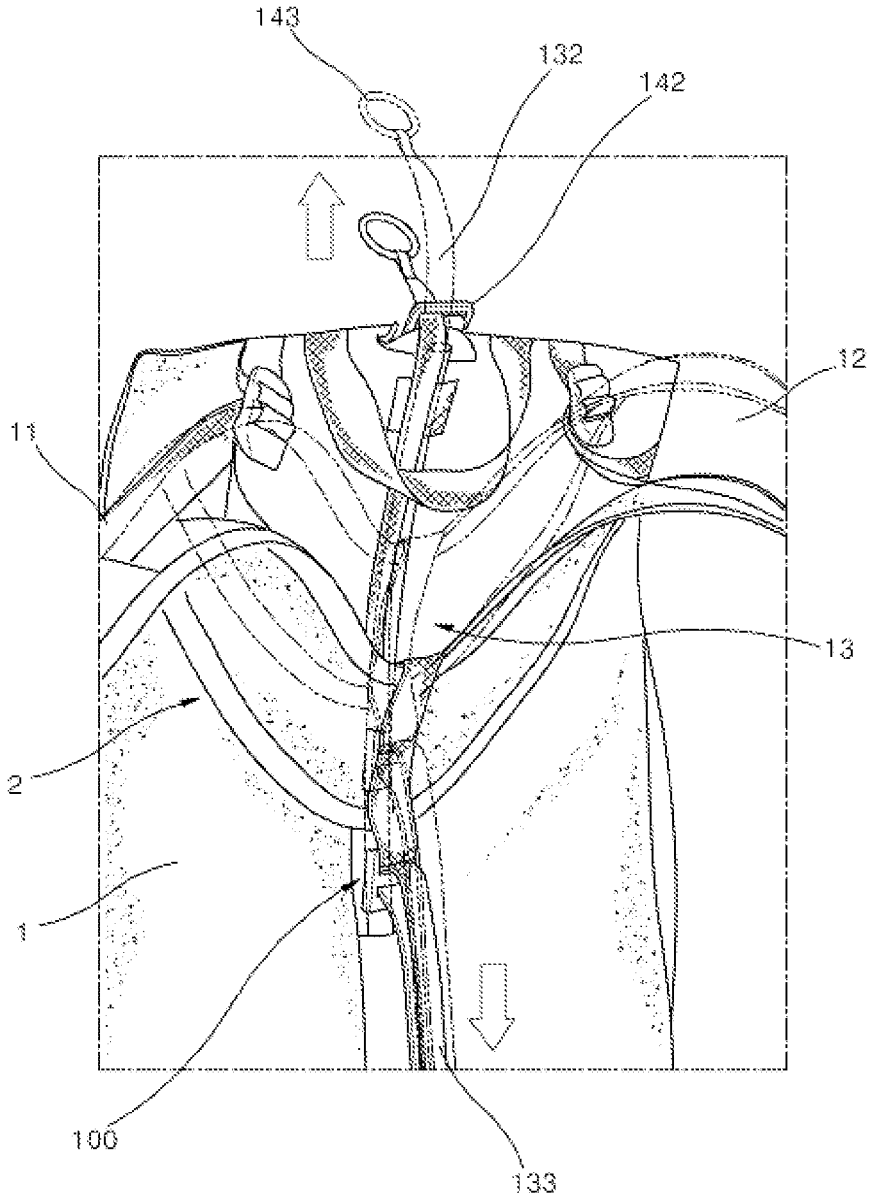
FIG. 10 is a partial perspective view illustrating an upwardly moving state of a height adjustment unit in accordance with the present invention.
Figure 11:
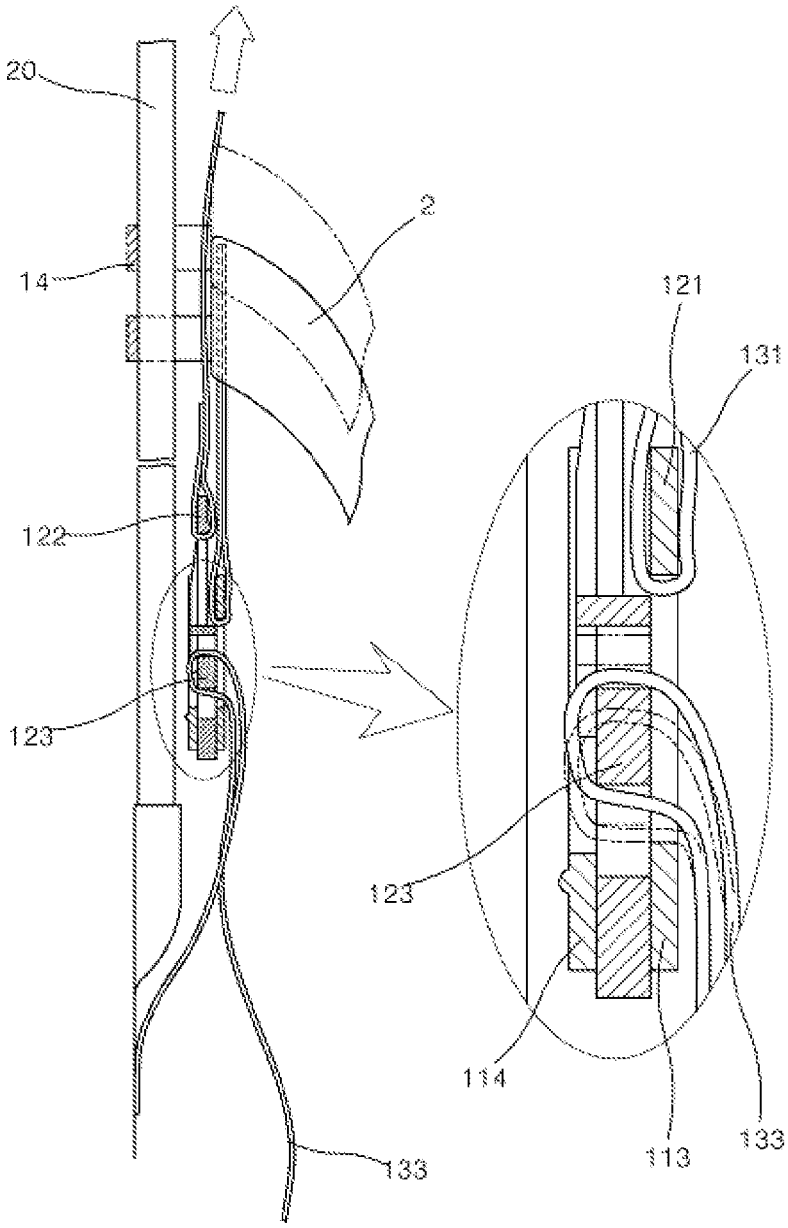
FIGS. 11A and 11B are longitudinal-sectional and partially enlarged views illustrating the state of FIG. 10.

FIG. 10 is a partial perspective view illustrating an upwardly moving state of the elevation part 13 of the shoulder straps 2 by pulling the second strap 132 upwards, and FIGS. 11A and 11B are longitudinal-sectional and partially enlarged views illustrating the state of FIG. 10. As shown in FIG. 10 and FIGS. 11A and 11B, when the upper end of the second strap 132 is pulled upwards, the second connector 102 connected to the lower end of the second strap 132 is lifted up and is moved upwards with respect to the first connector 101, the third strap 133 inserted into the gap between the slot frames 113 and 114 and the third strap bar 123 becomes a free state, and thus the strap connector 100 and the shoulder straps 2 are guided by the rail frame 20 and are moved upwards.

When the force applied to the second strap 132 is released at a desired position, the second connector 102 falls free end and is downwardly connected to the inside of the first connector 101 and thus fixes the third strap 133, and the shoulder straps 2 have the upper limit at such a position.

That is, when the elevation part 13 of the shoulder straps 2 is lifted up under the above state, the first connector 101 hung on the shoulder straps 2 is pulled upwards and connection of the first connector 101 with the second connector 102 is more reinforced, and thus the shoulder straps 2 are not moved above the set position.

Figure 12:
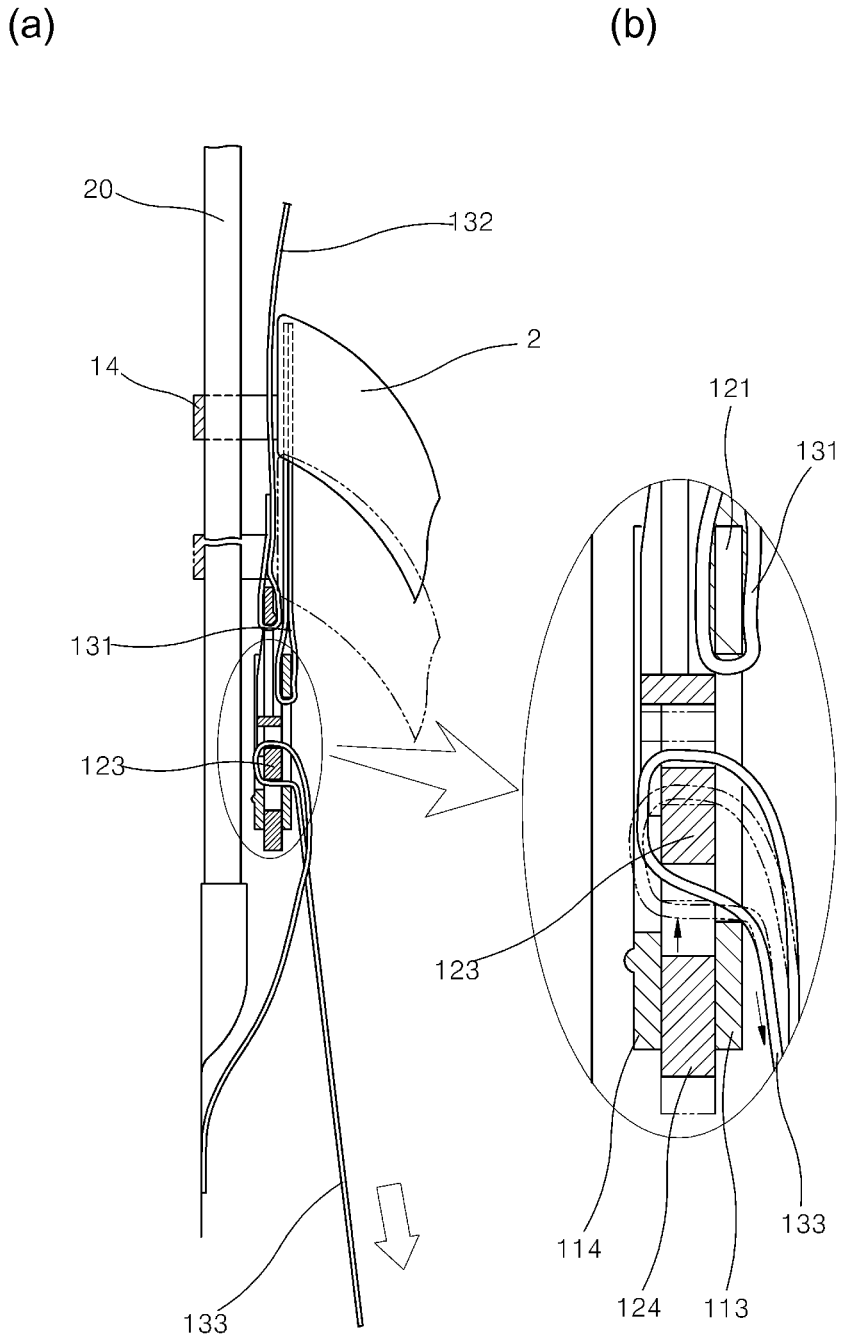
FIGS. 12A and 12B are longitudinal-sectional and partially enlarged views illustrating a downwardly moving state of the height adjustment unit in accordance with the present invention.

FIGS. 12A and 12B are longitudinal-sectional and partially enlarged views illustrating a downwardly moving state of the elevation part 13 of the shoulder straps 2 by pulling the third strap 133 downwards. As shown in FIGS. 12A and 12B, when the free end of the third strap 133 is pulled downwards, the third strap 133 pushes the third strap bar 123 upwards using the high slot frame 113 as a lever, and thus the second connector 102 is moved upwards with respect to the first connector 101.

Such an initial state is continuously maintained during pulling the third strap 133, and the shoulder straps 2 are moved downwards together with the strap connector 100 due to the pulling of the third strap 133. Then, when the force applied to the third strap 133 is released at a desired position, the second connector 102 is downwardly connected to the inside of the first connector 101 in the same manner as the original state, and then the location of the strap connector 100 at the corresponding position is maintained.

As described above, in accordance with the present invention, upward and downward movement of the elevation part 13 of the shoulder straps 2 is easily carried out by pulling the second strap 132 and the third strap 133, and the upper limit of the shoulder straps 2 is adjusted by connection between the first connector 101 and the second connector 102, thereby maintaining a set position.

As apparent from the above description, the present invention provides a backpack with a shoulder strap height adjustment unit which moves shoulder straps of the backpack upwards and downwards so as to adjust the height of the shoulder straps, thereby allowing a user to adjust the height of the shoulder straps so as to fit into the physical characteristics of the user.

Further, the backpack of the present invention simplifies upward and downward movement of the shoulder straps while stably maintaining a state in which the height of the shoulder straps is adjusted, thereby providing convenience and reliability in use to a consumer.

Moreover, the backpack of the present invention has improved stiffness while maintaining the overall balance of the backpack through a rail frame installed on a back surface of the backpack to adjust the height of the shoulder straps.

Although the preferred embodiment of the present invention has been disclosed for illustrative purposes, those skilled in the art will appreciate that various modifications, additions and substitutions are possible, without departing from the scope and spirit of the invention as disclosed in the accompanying claims. For example, a shape or a configuration of a strap connector may be variously modified as needed, and connected regions or fixed positions of respective straps may be variously modified according to surrounding circumferences.

What is claimed is:

1. A backpack with a shoulder strap height adjustment unit, the backpack comprising:

a back surface;

a rail frame vertically extended at the center of the back surface;

shoulder straps including left and right shoulder straps, the upper ends of which are connected integrally to form an elevation part, an elevation loop being formed at one surface of the elevation part opposite the other surface, on which the left and right shoulder straps are formed, and inserted into the rail frame such that the height of the left and right shoulder straps is adjustable along the rail frame; and a strap adjustment unit to adjust the height of the shoulder straps, wherein the strap adjustment unit comprises:

a strap connector;

a first strap to connect one end of the elevation part of the shoulder straps and the strap connector;

a second strap provided with one end connected and fixed to the strap connector and the other end serving as a free end and protruded to the upper portion of the backpack; and a third strap provided with one end fixed to one end of the lower portion of the back surface and the other end serving as a free end and protruded to the lower portion of the backpack via the strap connector, wherein the strap connector comprises:

a first connector formed in a U-shape having an entrance at the upper portion thereof, and provided with guide grooves formed along both inner side surfaces of the first connector from the upper surface of the first connector, a slot connected with the guide grooves and formed at the lower portion of the first connector by slot frames facing each other, and a first strap bar traversing the first connector and formed at the upper end of the first connector within a range not obstructing entrances of the guide grooves such that the first strap is connected to the first strap bar; and a second connector provided with a second strap bar formed at the upper portion thereof such that the second strap is connected to the second strap bar, a third strap bar traversing the second connector and formed at the middle portion thereof such that the third strap is connected to the third strap bar, and a guide plate extended downwards from both side surfaces of the second connector so as to be inserted into the guide grooves of the first connector from above.

2. The backpack according to claim 1, wherein the lower end of the rail frame is inserted into a pocket provided with the opened upper portion and formed at the lower portion of the center of the back surface, and the upper end of the rail frame is inserted into a loop formed at the upper portion of the center of the back surface.

3. The backpack according to claim 1, wherein a loop through which the second strap passes is formed at one end of the upper portion of the backpack, a ring is installed at the other end of the second strap, and the ring has a greater diameter than the inner diameter of the loop so as to maintain a state in which the other end of the second strap is inserted into the loop.

4. The backpack according to claim 1, wherein one slot frame among the slot frames facing each other to form the slot of the first connector has a height differing from the other slot frame.

5. The backpack according to claim 1, wherein stoppers are provided at the lower end of the body of the second connector by forming stepped portions at the middle portion of the guide plate and are caught by the upper end of one slot frame of the slot frames to form the slot.

6. The backpack according to claim 5, wherein the stoppers are located at both sides of the outer surface of the third strap bar.

7. The backpack according to claim 1, wherein stoppers are provided at the lower end of the body of the second connector by forming stepped portions at the middle portion of the guide plate and are caught by the upper end of one slot frame of the slot frames to form the slot, and the upper end of the other slot frame contacts the lower end of the third strap bar.

8. The backpack according to claim 1, wherein the rail frame is made of a synthetic resin or metal, and is formed in a gentle curve along the body line of a user.

9. The backpack according to claim 1, wherein the lower ends of the left and right shoulder straps are respectively fixed to left and right sides of the lower portion of the back surface.

* * * * *